US012208952B2

(12) United States Patent
Schultz et al.

(10) Patent No.: US 12,208,952 B2
(45) Date of Patent: Jan. 28, 2025

(54) PAPER BLISTER

(71) Applicant: Sonoco Development, Inc., Hartsville, SC (US)

(72) Inventors: Michael Lee Schultz, Sycamore, IL (US); Bradley James Linane, Elburn, IL (US)

(73) Assignee: Sonoco Development, Inc., Hartsville, SC (US)

( * ) Notice: Subject to any disclaimer, the term of this patent is extended or adjusted under 35 U.S.C. 154(b) by 57 days.

(21) Appl. No.: 18/326,411

(22) Filed: May 31, 2023

(65) Prior Publication Data

US 2023/0382621 A1 Nov. 30, 2023

Related U.S. Application Data

(60) Provisional application No. 63/347,241, filed on May 31, 2022.

(51) Int. Cl.

| | |
|---|---|
| ***B65D 5/20*** | (2006.01) |
| ***B65D 75/36*** | (2006.01) |
| ***B65D 75/52*** | (2006.01) |
| ***B65D 75/56*** | (2006.01) |

(52) U.S. Cl.

CPC ..... *B65D 75/366* (2013.01); *B65D 5/20* (2013.01); *B65D 75/522* (2013.01); *B65D 75/566* (2013.01); *B65D 2575/565* (2013.01)

(58) Field of Classification Search

CPC ..... B65D 5/20; B65D 5/2047; B65D 75/366; B65D 75/522; B65D 2565/385; B65D 2575/565

USPC ..... 206/461, 467, 764, 765; 229/113, 114, 229/122.27, 122.28, 169

See application file for complete search history.

(56) References Cited

U.S. PATENT DOCUMENTS

| | | | |
|---|---|---|---|
| 646,638 | A | 4/1900 | Cutler |
| 2,634,046 | A | 4/1953 | Weber |
| 2,770,406 | A | 11/1956 | Gardiner |

(Continued)

FOREIGN PATENT DOCUMENTS

| | | | |
|---|---|---|---|
| EP | 0005368 | B1 | 10/1983 |
| JP | 2012188159 | A | 10/2012 |
| KR | 20140130903 | A | 11/2014 |

OTHER PUBLICATIONS

"Cardboard Mono-Material Pack": Dated: Oct. 27, 2017: Website https://www.koch-pac-systeme.com/en/blister/blister-packaging/cardboard-mono-materialpack/.

(Continued)

*Primary Examiner* — Luan K Bui

(74) *Attorney, Agent, or Firm* — von Briesen & Roper, s.c.

(57) ABSTRACT

A paper-based blister package comprising a flat card and a tray is provided. The tray comprises a bottom wall, two opposing side walls, two opposing end walls, two opposing side flanges, and two opposing end flanges. The bottom wall has a perimeter defined by two side fold lines and two end fold lines. Each side flange has at least one locking end that meets a side wall and a side flange fold line at a junction. The side flange and the side wall are contoured to define a side flange shoulder adjacent the junction. At least one end flange forms an outward projecting lip configured to engage the junction to maintain proper positioning of the side flange, the end flange, the side wall and the end wall.

20 Claims, 9 Drawing Sheets

(56) References Cited

U.S. PATENT DOCUMENTS

| | | | | |
|---|---|---|---|---|
| 3,104,012 | A * | 9/1963 | Beamish | B65D 77/22 206/525 |
| 3,232,423 | A | 2/1966 | Morton | |
| 3,486,615 | A | 12/1969 | De Woskin | |
| 4,114,797 | A | 9/1978 | Manizza | |
| 4,257,530 | A * | 3/1981 | Faller | B65B 9/04 229/905 |
| 4,417,882 | A * | 11/1983 | Wallin | B65D 5/246 493/174 |
| 4,540,612 | A | 9/1985 | Rhyner | |
| 5,316,165 | A | 5/1994 | Moran, Jr. | |
| 5,427,309 | A | 6/1995 | Voss | |
| 5,429,233 | A | 7/1995 | Juaristi | |
| 5,564,569 | A | 10/1996 | Kiefer | |
| 5,618,253 | A | 4/1997 | Okushita | |
| 6,739,453 | B1 | 5/2004 | Mazurek | |
| 6,761,307 | B2 | 7/2004 | Matsuoka | |
| 7,387,203 | B2 | 6/2008 | Siecke | |
| 8,083,058 | B2 | 12/2011 | Marcinkowski et al. | |
| 8,132,394 | B2 | 3/2012 | Koike | |
| 8,646,244 | B2 * | 2/2014 | Ludwig | B29C 66/242 53/329.2 |
| 8,763,806 | B2 | 7/2014 | Ludwig | |
| 9,803,322 | B2 | 10/2017 | Kuo et al. | |
| 11,691,778 | B2 * | 7/2023 | Zwaga | B65D 5/243 229/113 |
| 2002/0189964 | A1 | 12/2002 | Mazurek | |
| 2009/0127155 | A1 | 5/2009 | Nottoli et al. | |
| 2013/0327821 | A1 * | 12/2013 | Zwaga | B65D 5/563 53/403 |
| 2014/0047798 | A1 | 2/2014 | Jenkins | |
| 2014/0231293 | A1 | 8/2014 | Nietvelt | |
| 2015/0203266 | A1 | 7/2015 | Wu et al. | |
| 2018/0265270 | A1 | 9/2018 | McClaughry | |
| 2018/0319568 | A1 * | 11/2018 | Tye | B65D 77/286 |

OTHER PUBLICATIONS

International Search Report and Written Opinion related to Application No. PCT/US2023/023941; reported on Sep. 20, 2023.

* cited by examiner

PAPER BLISTER

CROSS-REFERENCE TO RELATED APPLICATION

This patent application claims the benefit of U.S. Provisional Application No. 63/347,241 filed May 31, 2022, which is incorporated by reference herein.

TECHNICAL FIELD

This patent relates to a blister type package. More particularly, this patent relates to a blister type package made entirely or primarily from paper that holds its shape during sealing.

BACKGROUND

In traditional face-seal style blister packages, a product or products are dropped into a transparent thermoformed plastic shell and a paper-based backing card is sealed via heat and pressure to a flange extending outward from the face perimeter of the plastic shell. Composite (multiple material) blister packages of this type enable the seller to display the product visually for sale and enable the package manufacturer to create the package with just a few packaging components and fast sealing. The package may include a heat seal coating on the paper component and not the plastic shell component.

Occasionally packages requiring greater security, structure or decoration will incorporate two pieces of paperboard, sandwiching the plastic blister (or blisters) in between in a trapped package. Sealing is affected the same way as in the traditional face-seal style blister package, that is, through heat and pressure.

Recently the packaging industry has been pursuing sustainable, environmentally friend packaging including little to no plastic and having components that are easily recyclable. The present disclosure addresses this and other needs.

SUMMARY OF THE DISCLOSURE

The present disclosure relates to a paper-based blister type package that holds its shape during sealing. The package components can be shipped flat and loaded easily into existing blister package equipment. The package may be formed in the machine just prior to the filling operation, and then sealed in the same fashion as a traditional plastic blister back card seal.

In one aspect of the present disclosure, a blister package for holding one or more products is disclosed. The blister package may include a face card and a tray made from a tray blank fabricated from a recyclable material. The tray may include a tray bottom wall having a perimeter defined by two side wall fold lines and two end wall fold lines, two opposing tray side walls attached to the tray bottom wall along the side wall fold lines and extending upward from the tray bottom wall to side flange fold lines, each tray side wall having two side wall free edges, and two opposing tray end walls attached to the tray bottom wall along the end wall fold lines and extending upward from the tray bottom wall to end flange fold lines, each tray end wall having two end wall free edges. The tray may further include two opposing tray side flanges, each tray side flange extending outward from and attached to a corresponding one of the tray side walls along a corresponding one of the side flange fold lines, each tray side flange having at least one side flange locking end extending laterally beyond the corresponding side flange fold line, wherein the side flange locking end of the tray side flange, the side wall free edge of the tray side wall and the side flange fold line meet at a junction, and wherein the tray side flange and the side wall free edge of the side wall are contoured to define a side flange shoulder in the tray side flange adjacent the junction, and two opposing tray end flanges, each tray end flange extending outward from and attached to a corresponding one of the tray end walls along a corresponding end flange fold line, at least one tray end flange extending laterally beyond the corresponding end flange fold line to form a lip that projects outward beyond the end wall free edge of the tray end wall at approximately a 90° angle. The lip may engage the tray side wall at the junction to maintain alignment of the tray side flange, the tray end flange, the tray side wall and the tray end wall.

In another aspect of the present disclosure, a tray blank for forming a tray of a blister package for a product is disclosed. The tray blank may be fabricated from a recyclable material, and the tray blank may include a tray bottom wall, a first tray side wall connected to the tray bottom wall along a first side wall fold line and having a first side wall free edge at each end of the first tray side wall, a first tray side flange connected to the first tray side wall along a first side flange fold line opposite the first side wall fold line, a second tray side wall connected to the tray bottom wall along a second side wall fold line opposite the first side wall fold line and having a second side wall free edge at each end of the second tray side wall, and a second tray side flange connected to the second tray side wall along a second side flange fold line opposite the second side wall fold line. The tray blank may further include a first tray end wall connected to the tray bottom wall along a first end wall fold line extending from the first side wall fold line to the second side wall fold line and having a first end wall free edge at each end of the first tray end wall, a first tray end flange connected to the first tray end wall along a first end flange fold line opposite the first end wall fold line, a second tray end wall connected to the tray bottom wall along a second end wall fold line extending from the first side wall fold line to the second side wall fold line opposite the first end wall fold line and having a second end wall free edge at each end of the second tray end wall, wherein the first side wall fold line, the second side wall fold line, the first end wall fold line and the second end wall fold line define a perimeter of the tray bottom wall, and a second tray end flange connected to the second tray end wall along a second first end flange fold line opposite the second end wall fold line, wherein the second tray end flange extends laterally beyond ends of the second end flange fold line to define lips that engage the corresponding first side wall free edge and second side wall free edge when the tray blank is folded into the tray to limit the rotation of the second tray end wall about the second end wall fold line at a predetermined position.

In a further aspect of the present disclosure, a tray for a blister package for a product is disclosed. The tray may be formed from a tray blank fabricated from a recyclable material, and the tray may include a tray bottom wall, a first tray side wall connected to the tray bottom wall and folded along a first side wall fold line to extend upward from the tray bottom wall, and having a first side wall free edge at each end of the first tray side wall, a first tray side flange connected to the first tray side wall and folded along a first side flange fold line opposite the first side wall fold line to extend horizontally outward from the first tray side wall, a second tray side wall connected to the tray bottom wall and folded along a second side wall fold line opposite the first side wall fold line to extend upward from the tray bottom wall, and having a second side wall free edge at each end of the second tray side wall, and a second tray side flange connected to the second tray side wall and folded along a second side flange fold line opposite the second side wall fold line to extend horizontally outward from the second tray side wall. The tray may further include a first tray end wall connected to the tray bottom wall and folded along a first end wall fold line extending from the first side wall fold line to the second side wall fold line to extend upward from the tray bottom wall, and having a first end wall free edge at each end of the first tray end wall, a first tray end flange connected to the first tray end wall and folded along a first end flange fold line opposite the first end wall fold line to extend horizontally outward from the first tray end wall, a second tray end wall connected to the tray bottom wall and folded along a second end wall fold line extending from the first side wall fold line to the second side wall fold line opposite the first end wall fold line to extend upward from the tray bottom wall, and having a second end wall free edge at each end of the second tray end wall, wherein the first side wall fold line, the second side wall fold line, the first end wall fold line and the second end wall fold line define a perimeter of the tray bottom wall, and a second tray end flange connected to the second tray end wall and folded along a second first end flange fold line opposite the second end wall fold line to extend horizontally outward from the second tray end wall, wherein the second tray end flange extends laterally beyond ends of the second end flange fold line to define lips engaging the corresponding first side wall free edge and second side wall free edge and limiting the rotation of the second tray end wall about the second end wall fold line at a predetermined position.

In another aspect a paper-based blister type package is provided comprising a face card and a tray. The tray may comprise a tray bottom wall, two opposing tray side walls, two opposing tray end walls, two opposing tray side flanges, and two opposing tray end flanges. The tray bottom wall has a perimeter defined by two side wall fold lines and two end wall fold lines.

The two opposing tray side walls are attached to the tray bottom wall along the side wall fold lines and extend upward from the tray bottom wall to side flange fold lines. Each tray side wall has two side wall free edges. Similarly, the two opposing tray end walls are attached to the tray bottom wall along the end wall fold lines and extend upward from the tray bottom wall to end flange fold lines. Each tray end wall has two end wall free edges.

Each tray side flange extends outward from and is attached to a tray side wall along a side flange fold line. Each tray end flange extends outward from and is attached to a tray end wall along an end flange fold line.

Each side wall flange has at least one side flange locking end that extends laterally beyond the side flange fold line. At least one tray end flange has ends that extend laterally beyond the corresponding end flange fold lines to form a lip that projects outward beyond the end wall free edge of the tray end wall at about a 90° degree angle.

The side flange locking end of the tray side flange, the side wall free edge of the side wall and the side flange fold line all meet at a junction. The tray side flange and the side wall free edge of the side wall are contoured so as to define a side flange shoulder adjacent the junction. The lip is configured to engage the junction during a sealing operation to maintain proper positioning of the tray side flange, the tray end flange, the tray side wall and the tray end wall.

Additional aspects are defined by the claims of this patent.

DETAILED DESCRIPTION

The term "fold line" as used herein may refer to a fold line, a score line, an ablated channel or multiple parallel fold lines, score lines or ablated channels in close proximity so as to function as a fold line.

Figure 1:
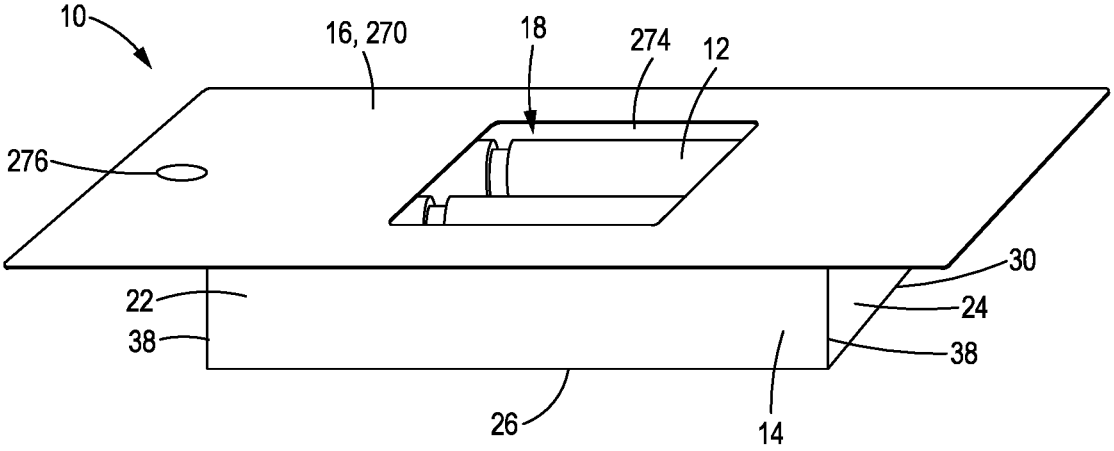
FIG. 1 (PRIOR ART)
FIG. 1 is a side perspective view of a conventional paper blister package.
Figure 2:
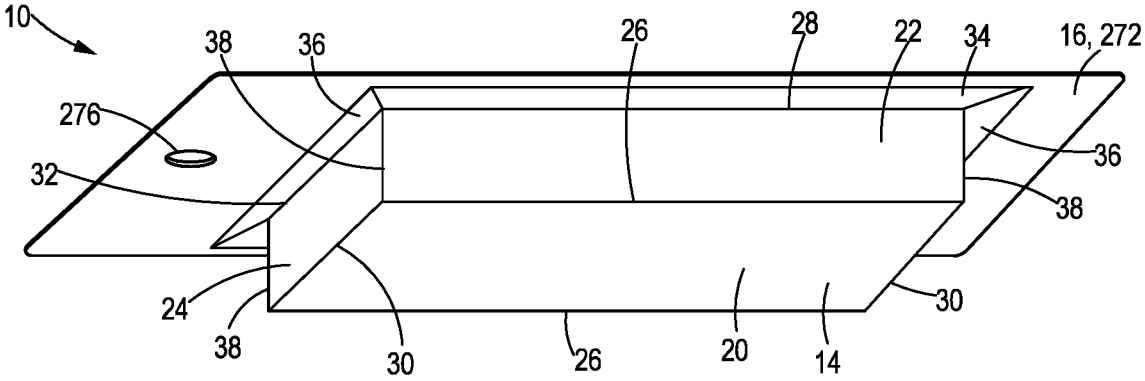
FIG. 2 (PRIOR ART)
FIG. 2 is a bottom perspective view of the paper blister package of FIG. 1.

Turning to the drawings, FIGS. 1 and 2 illustrate a conventional blister package 10 fabricated from paperboard components. The package 10 may be referred to as a blister-type package in that the products 12 are dropped into a shell or tray 14, and a flat face card 16 is heat sealed to the tray 14 to enclose the products 12 in a tray cavity 18. However, in this package 10, the tray 14 is not a plastic component formed as a blister, but rather is a paper component.

The package 10 comprises the tray 14 and the flat card 16, both of which may be formed from paper-based blanks. More particularly, the tray 14 of the package 10 may include a tray bottom wall 20, two opposing tray side walls 22 and two opposing tray end walls 24. Each tray side wall 22 extends upward from the tray bottom wall 20 from a side wall fold line 26 to a side flange fold line 28, and each tray end wall 24 extends upward from the tray bottom wall 20 from an end wall fold line 30 to an end flange fold line 32. Together, the side flange fold lines 28 and the end flange fold lines 32 comprise a face perimeter of the tray 14. The package 10 also comprises tray side flanges 34 each extending outward from a corresponding one of the tray side walls 22 and tray end flanges 36 each extending outward from a corresponding one of the tray end walls 24 at the end flange fold line 32. Together or individually, the tray side flanges 34 and the tray end flanges 36 may be referred to as sealing flanges. The face or flat card 16 is sealed to the tray side flanges 34 and the tray end flanges 36 to enclose and protect the products 12.

The tray bottom wall 20 may be rectangular and have a periphery comprising the two opposing side wall fold lines 26 and the two opposing end wall fold lines 30. The tray side walls 22 are attached to the tray bottom wall 20 along the side wall fold lines 26. The tray end walls 24 are attached to the tray bottom wall 20 along the end wall fold lines 30. Each tray side wall 22 extends in a longitudinal direction from one tray corner 38 to an opposite tray corner 38. Similarly, each tray end wall 24 extends from one tray corner 38 to an opposite tray corner 38.

The package 10 may be used to hold one or more products 12, such as the substantially cylindrical products shown in the FIG. 1. The products 12 may have their own primary packaging, such as a wrapper, so that a consumer may touch the exterior of the primary packaging without damaging the actual products 12.

Figure 3:
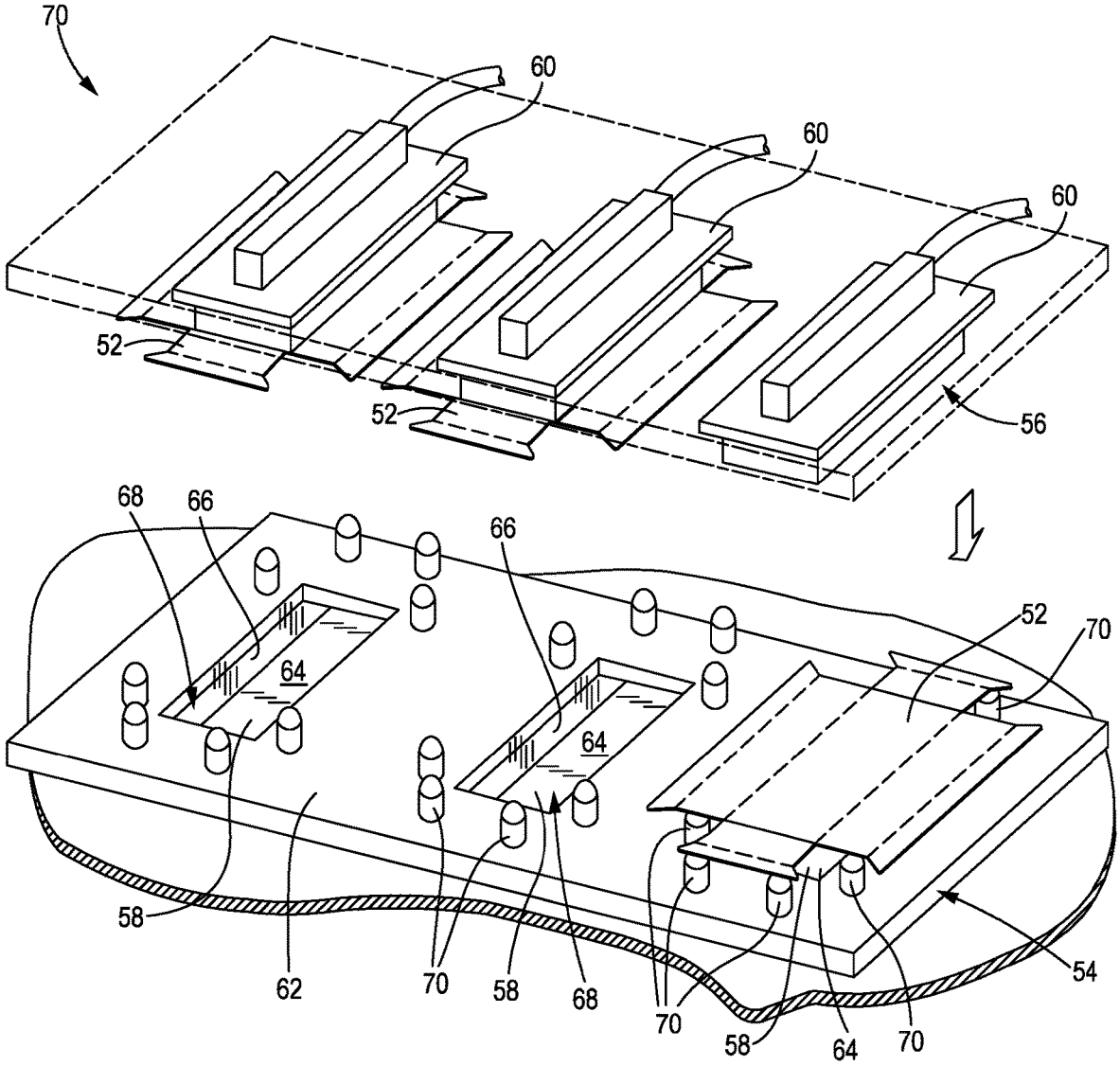
FIG. 3 is a perspective view of an exemplary blister forming apparatus.

FIG. 3 is a perspective view of a blister forming apparatus 50 used to make paper blister packages such as those described herein. The forming apparatus 50 is shown with conventional tray blanks 52 for illustration purposes only. The conventional tray blanks 52 are dissimilar in some important respects to the tray blanks in accordance with the present disclosure described below.

The forming apparatus 50 comprises a nesting apparatus 54 and a forming block apparatus 56. The nesting apparatus 54 comprises three nesting trays 58 and the forming block apparatus 56 comprises three corresponding forming blocks 60. Although FIG. 3 depicts three nesting trays 58 and three forming blocks 60 for simultaneously making three packages 10, it should be understood that the forming apparatus 50 may comprise any number of paired nesting trays 58 and forming blocks 60, including just a single nesting tray 58 and forming block 60.

The nesting apparatus 54, and thus each nesting tray 58, has a top surface 62. Each nesting tray 58 also has a bottom wall 64 and four side walls 66 that define a recess 68 in which a tray 14 can be formed. The nesting tray 58 may comprise locator pins 70 extending upward from the top surface 62 and positioned to locate and hold a tray blank 52 and/or a face card 16 on the nesting tray 58. In order to form the conventional rectilinear tray 14 shown in FIGS. 1 and 2, the side walls 66 and end walls of the nesting tray 58 may be substantially perpendicular to the bottom wall 64 of the nesting tray 58.

Figure 4:
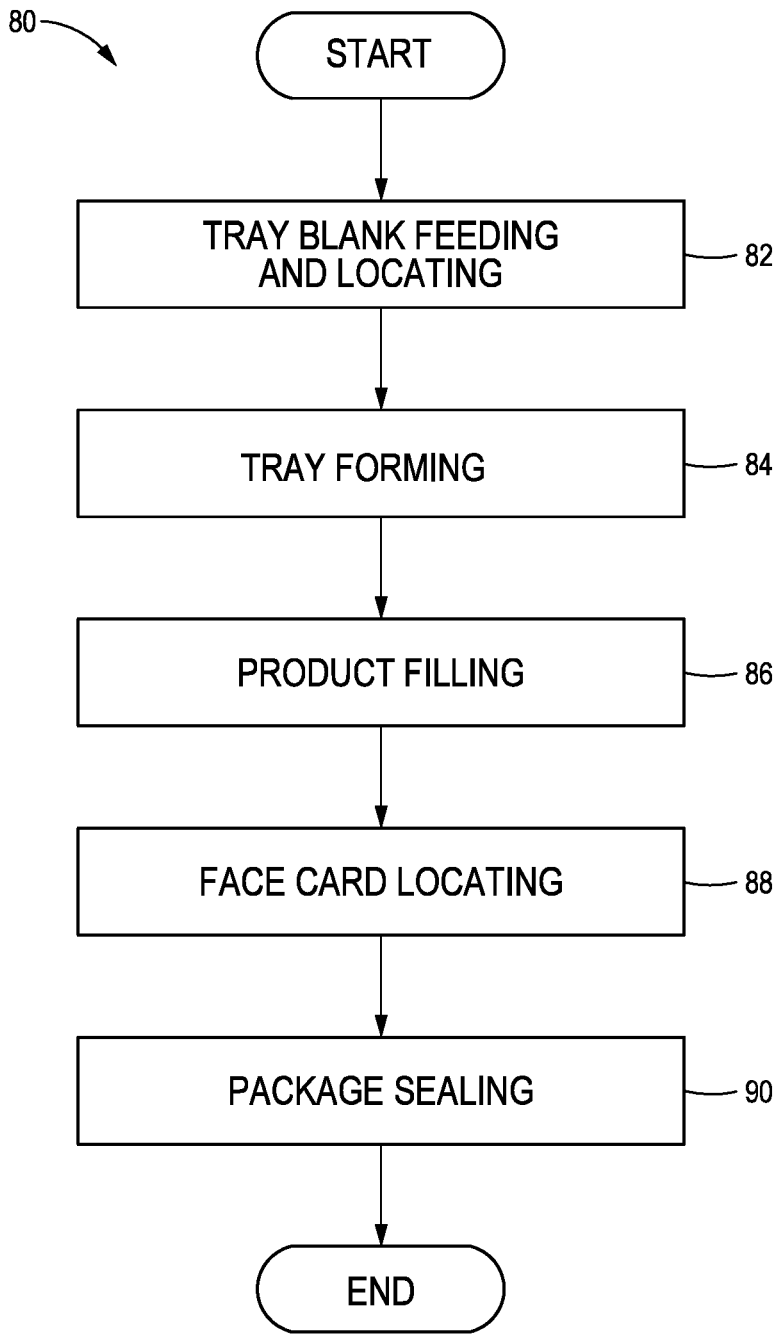
FIG. 4 is a flow diagram of an exemplary package forming routine.

A paper blister package 10 of the type described herein may be manufactured using a forming apparatus 50 similar to that shown in FIG. 3 according to a package forming routine 80 as shown in FIG. 4, for example. The routine 80 may begin at a step 82 wherein one or more tray blanks, such as tray blanks 52 in FIG. 3, may be fed from a chute and located onto the nesting tray 58 using a forming block 60. The forming block 60 may have a vacuum device that allows it to grab the tray blanks 52 from a tray blank chute and locate the tray blanks 52 onto a nesting tray 58. If locator pins 70 are present, the tray blanks 52 may be suspended by the locator pins 70 above the tray cavity or recess 68.

The routine 80 may pass to a step 84 where the forming block 60 is lowered in the direction of the arrow in FIG. 3 toward the recess 68 of the nesting tray 58. The tray blank 52, although being flat or substantially flat, has cuts and creases in the proper locations to fold and conform to the nesting tray 58. As the forming block 60 begins entering the recess 68, the tray blank 52 begins folding along its fold lines 26-32. As the forming block 60 advances further into the recess 68 and eventually bottoms out, the tray blank 52 continues to fold along its fold lines 26-32 and finally assumes the general shape of a tray 14. The flanges 34, 36 are folded backward over the top surface 62 of the nesting tray 58. The forming block 60 may press the tray side flanges and the tray end flanges against the top surface 62 of the nesting tray 58. The tray bottom wall 20 lies flat against the nesting tray bottom wall 64. There may be a narrow gap or space between the tray side walls 22 and the side walls 66 of the nesting tray 58 to allow the formed tray 14 to be easily extracted from the recess 68. The forming block 60 is then withdrawn from the recess 68, leaving the formed tray 14 in the recess 68. At this point, the flanges 34, 36 may be positioned at an acute included angle with respect to the horizontal plane defined by the tray bottom wall 20.

At a step 86, the product(s) 12 are loaded into the formed tray while the tray 14 is still residing in the nesting tray 58. The product(s) 12 may be dropped into the cavity of the tray 14, which is sized appropriately for the products 12. At a step 88, the flat card 16 is then fed from the feeding chute and placed on top of the formed tray by the feeder and located (positioned) on the formed tray by the locator pins 70. Finally, at a step 90, the package 10 may be sealed by heating a heat seal coating with a heating plate or other heating device (not shown) so that the heat seal coating on the underside of the flat card 16 and/or the tray flanges 34, 36 causes the two components to bond to each other, effectively sealing the package 10. The heating device may press the flat card 16 flat against the pre-folded flanges 34, 36 on the tray 14 during the sealing step 90, moving the flanges 34, 36 into their final horizontal position.

When working with a preformed plastic blister, all of the tray shape is defined and formed without concern that the tray shape will be altered during the sealing of the plastic blister package. However, in the case of a paper blister where the tray is not pre-formed, the final tray forming takes place during the sealing process. For instance, before the sealing step 90, the flanges 34, 36 define an acute included angle (flange angle) with respect to a horizontal plane defined by the tray bottom wall 20. During the sealing step 90 when the flat card 16 is pressed against the flanges 34, 36, the flange angle will increase (to about ninety degrees) as the flanges 34, 36 reach a horizontal orientation suitable for sealing with the flat card 16. This change in flange angle is accomplished when the heat block 60 of the press station pushes the flat card 16 firmly against the flanges 34, 36.

When each tray side flange 34 and tray end flange 36 is being moved to the horizontal plane defined by the tray bottom wall 20 and/or the face card 16 during the sealing step 90, without the interlock feature described below, the tray end wall 24 can slide past the tray side walls 22 and push against the tray side walls 22, changing the position of the tray side walls 22 and their angle with respect to the tray bottom wall 20. This relative sliding of the tray end wall 24 with respect to the tray side walls 22 can cause the tray end flange 36 to move the tray side flanges 134 and, correspondingly, the tray side walls 22 outward away from the tray cavity 18 along a horizontal plane and can leave the tray end flange 36 and the tray side flanges 34 out of proper location, or dislocated, at the tray corners 38 for the sealing step 90. This dislocation phenomenon will now be described with respect to a paper blister package 110 shown in FIGS. 5-7 where similar structures as discussed above for the blister package 10 are identified by the same reference numerals with a leading "1" added. The reference numerals for these corresponding structures are included in FIGS. 4-6 even where the structures are not explicitly discussed in the following description. The blister package 110 does not possess the wall interlocking feature that is a subject of this disclosure.

Figure 5:
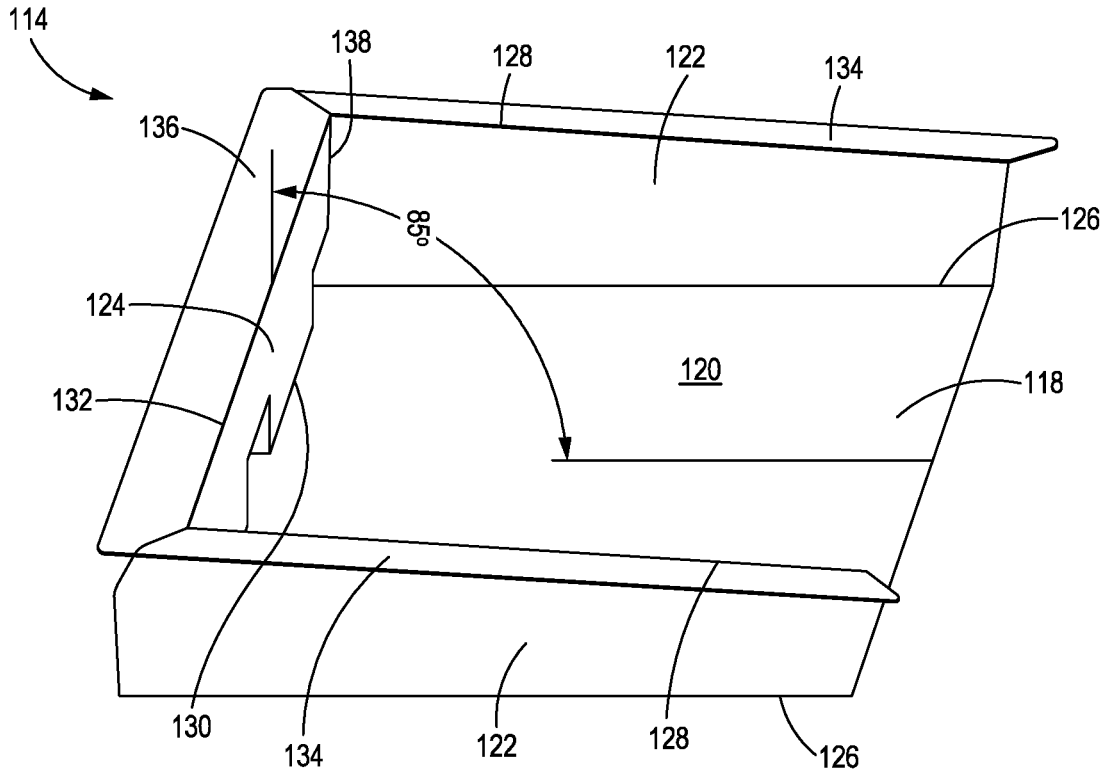
FIG. 5 is a perspective cutaway view of a blister package with a face card removed to illustrate a configuration of a tray after a sealing step.
Figure 6:
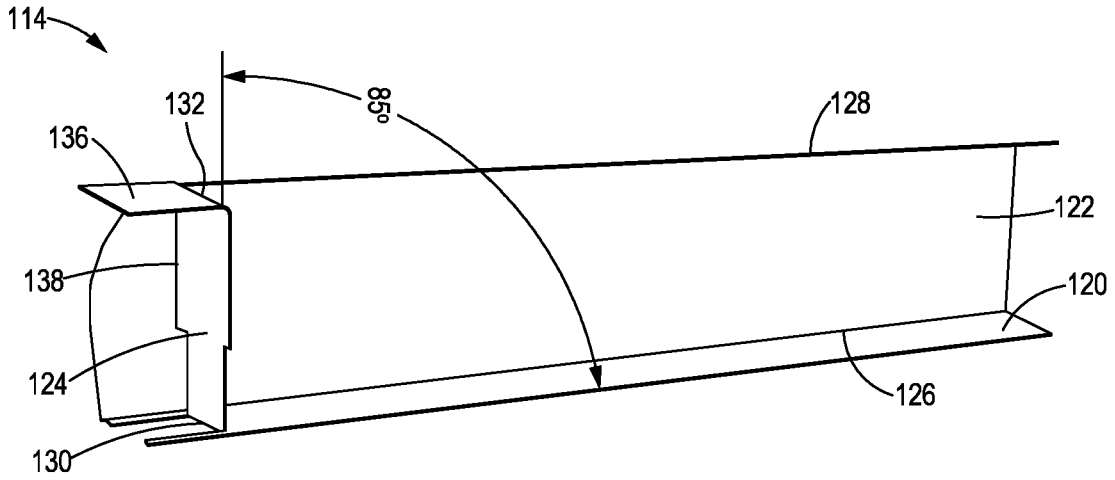
FIG. 6 is perspective cutaway view of the tray of FIG. 5 showing one tray side wall and a portion of a tray bottom wall.
Figure 7:
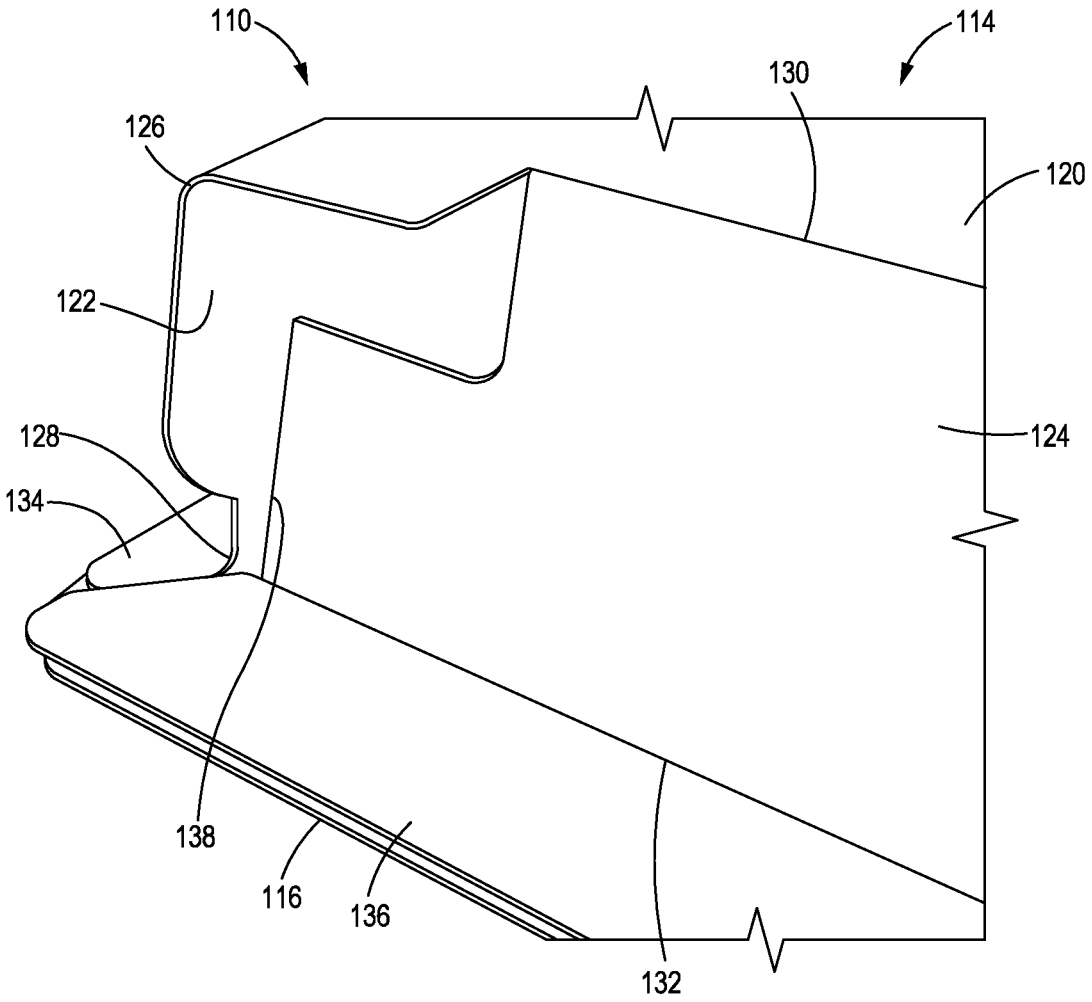
FIG. 7 is a bottom perspective view of a lower corner of the paper blister package of FIG. 5 showing misaligned tray walls and flanges.

FIGS. 5 and 6 are perspective cutaway views of a paper blister package 110 with the face card 116 (FIG. 7) removed to better show the orientation of the tray 114 after the sealing step 90. FIG. 7 is a close-up bottom perspective view of the paper blister package 110 comprising the tray 114 and the face flat card 116. Preferably, the tray end wall 124 forms an included angle with the tray bottom wall 120 of 90° or greater. However, during the package forming routine 80, the bottom tray end wall 124 has slid or moved too far inward and forms an included acute angle of only 85° with the tray bottom wall 120. As perhaps best shown in FIG. 7, the tray end wall 124 has pushed in and widened the two opposing tray side walls 122. It is also preferred that the tray side flanges 134 and the tray end flange 136 define slight gaps at the tray corners 138 of the sealing area. However, in FIG. 7, there is no gap between the tray side flange 134 and the tray end flange 136 at the tray corner 138. These dislocation problems may be solved with Applicant's novel paper blister package 210 described below with reference to FIGS. 8-11 where similar structures as discussed above for the blister package 10 are identified by the same reference numerals with a leading "2" added.

Figure 8:
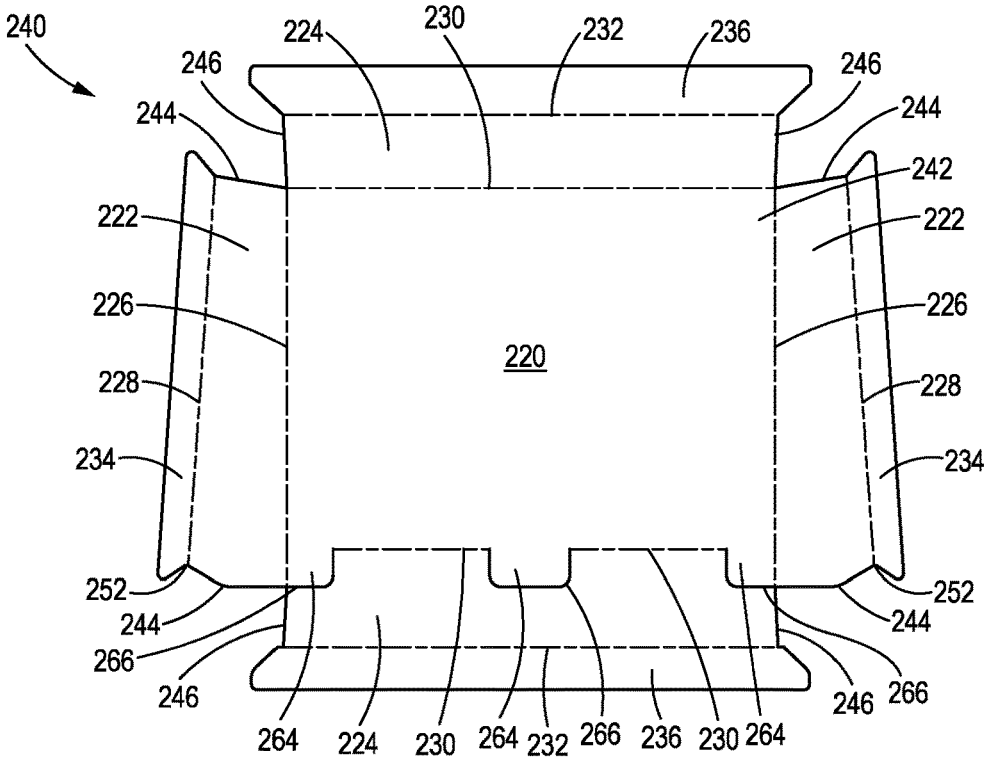
FIG. 8 is a plan view of a tray blank in accordance with the present disclosure used to make a tray of a blister package according with the present disclosure.

A novel paper blister package 210 having an interlocking feature in accordance with the present disclosure is provided comprising a tray 214 and a face card 216. The tray 214 may be made from a single unitary tray blank 240 that is mechanically formed into the tray 214 using a process similar to the package forming routine 80 described above. FIG. 8 is a top plan view of the tray blank 240. The tray blank 240 has a product facing side 242 (viewable in FIG. 8) and a back side (facing away from the viewer in FIG. 8). The tray blank 240 comprises a tray bottom wall 220, two opposing tray side walls 222 and two opposing tray end walls 224. The tray blank 240 also comprises two opposing tray side flanges 234 and two opposing tray end flanges 236. The tray blank 240 may have graphics printed on the product facing side 242, the back side or both.

The tray bottom wall 220 may be rectangular or any suitable shape. For example, the tray bottom wall 220 may have a periphery comprising two opposing parallel side wall fold lines 226 and two opposing parallel end wall fold lines 230. The tray bottom wall 220 may have a bottom wall width (i.e., the dimension from one side wall fold line 226 to the opposite side wall fold line 226) that is smaller than a card width of the face card 216 and a bottom wall height (i.e., the dimension from one end wall fold line 230 to the opposite end wall fold line 230) that is smaller than a card height of the face card 216. The tray side walls 222 are attached to the tray bottom wall 220 along the side wall fold lines 226. The tray end walls 224 are attached to the tray bottom wall 220 along the end wall fold lines 230.

In the tray blank 240 shown in FIG. 8, each tray side wall 222 extends outward from the tray bottom wall 220 to a side flange fold line 228, and each tray end wall 224 extends outward from the tray bottom wall 220 to an end flange fold line 232. Each tray side wall 222 and each tray end wall 224 may be rectangular, trapezoidal or any suitable shape. Each tray side wall 222 extends from one of the side wall fold lines 226 outward to the corresponding side flange fold line 228 and from one side wall free edge 244 to another side wall free edge 244. Each tray end wall 224 extends from an end wall fold line 230 to an end flange fold line 232 and laterally between opposing parallel end wall free edges 246. The side wall free edges 244 may be curved or any other suitable shape.

Figure 8A:
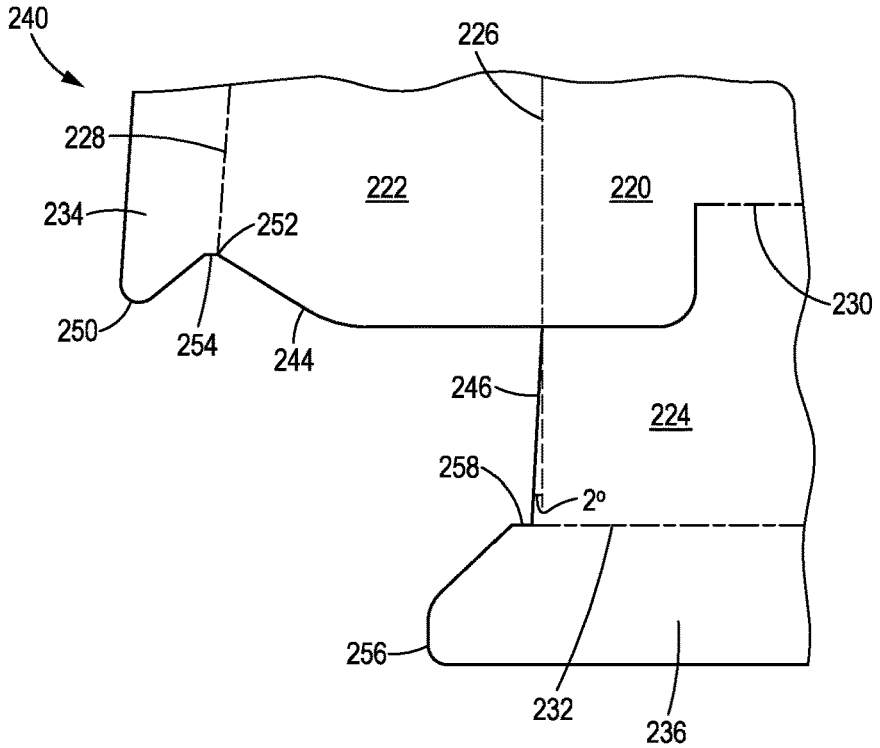
FIG. 8A is an enlarged view of detail 8A of FIG. 8.

FIG. 8A is a close up view of a bottom left portion of the tray blank 240 as shown in FIG. 8. As best shown in this figure, each tray side flange 234 has at least one side flange locking end 250 that extends laterally beyond the end of the side flange fold line 228. The side wall flange 234, the side wall free edge 244 of the tray side wall 222 and the side flange fold line 228 all meet at a junction 252. The tray side flange 234 and the side wall free edge 244 are contoured so as to define a side flange shoulder 254 of the tray side flange 234 adjacent the junction 252 at a base of the side flange locking end that is approximately perpendicular to and extends way from the side flange fold line 228. Also best seen in FIG. 8A, the end wall flange 236 has an end wall locking end 256 that extends laterally beyond the end flange fold line 232 creating a detent or lip 258. The end wall free edge 246 may extend from the end flange fold line 232 approximately parallel to the side wall fold line 226, or may extend at an angle relative to the side wall fold line 226, such as at the 2° angle shown in FIG. 8A, such that the tray side wall 222 will be angle slightly outward when the tray blank 240 is folded into the tray 214. The lip 258 projects outward beyond the end wall free edge 246 of the tray end wall 224 approximately parallel to the end flange fold line 232. The lip 258 is configured to engage the side flange shoulder 254 at the junction 252 during the package forming routine 100 when the tray 214 takes its final shape to limit the rotation of the tray end wall 224 about the end wall fold line 230 at a predetermined position. This interlocking feature serves to maintain the proper positioning of the tray side flanges 234 and the bottom tray end flange 236 as well as the tray side wall 222 and the tray end wall 224.

Figure 9:
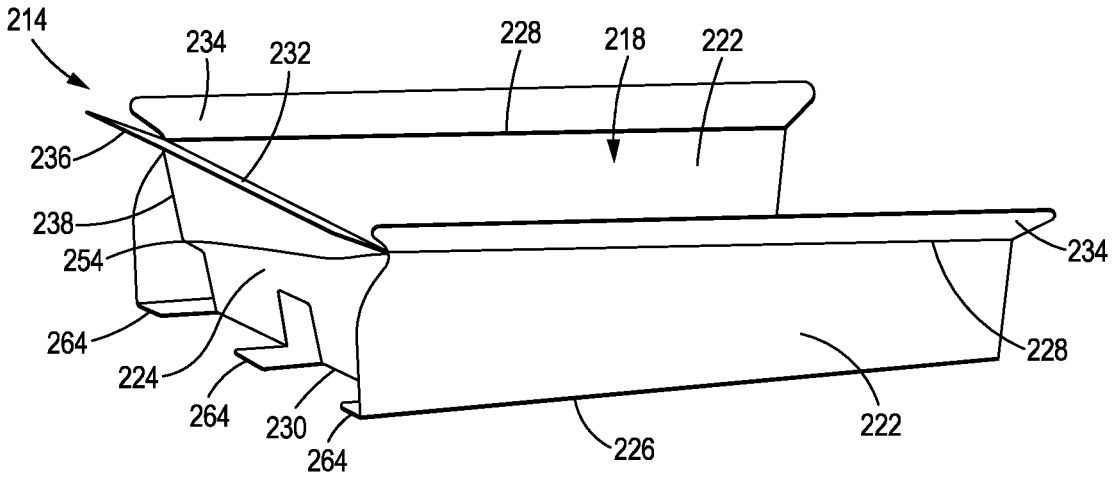
FIG. 9 is a side perspective view of the tray formed from the tray blank of FIG. 8 with a top tray end wall removed.

FIG. 9 is a side perspective view of the tray 214 made from the tray blank 240 of FIG. 8 with the top tray end wall 224 not shown in FIG. 8. The tray 214 comprises the tray bottom wall 220, two opposing tray side walls 222 and two opposing tray end walls 224. Each tray side wall 222 extends upward from the tray bottom wall 220 to a corresponding side flange fold line 228, and each tray end wall 224 extends upward from the tray bottom wall 220 to the corresponding end flange fold line 232. Together, the side flange fold lines 228 and the end flange fold lines 232 comprise the face perimeter of the tray 214. The tray 214 may also include the tray side flanges 234 extending outward from the corresponding tray side walls 222 and the tray end flanges 236 extending outward from the corresponding tray end walls 224. Each side flange 234 may be rectangular, trapezoidal or any suitable shape with the side flange locking ends 250 extending outward at least at the bottom side wall free edges 244. Likewise, each end flange 236 may be rectangular, trapezoidal or any suitable shape with the end flange locking ends 256 extending outward at least at the bottom end wall free edges 246. Together or individually the tray side flanges 26 and the tray end flanges 236 may be referred to as a sealing flange.

The package 210 may be comprised primarily of paperboard. The package 10 may be referred to as a blister package in that product or products 12 may be dropped into the tray 14 and a face card 216 then may be heat sealed or otherwise affixed to the tray 214. However, in this case the tray 214 is not a plastic component formed as a blister, but rather a paper component folded into the tray 214.

The face card 216 is sealed to the tray side flanges 234 and the tray end flanges 236 to enclose and protect the products 12. The flat cards 12 as well as the tray blanks 240 used to make the trays 214 may be produced and delivered to a customer as flat components, then the package 210 may be formed in-line with the customer's product filling operation as described in some detail below. The package 210 may be used to hold one or more products 12. The products 12 may have their own primary packaging, such as a wrapper, so that a consumer may touch the exterior of the primary packaging without damaging the actual products 12.

Figure 10:
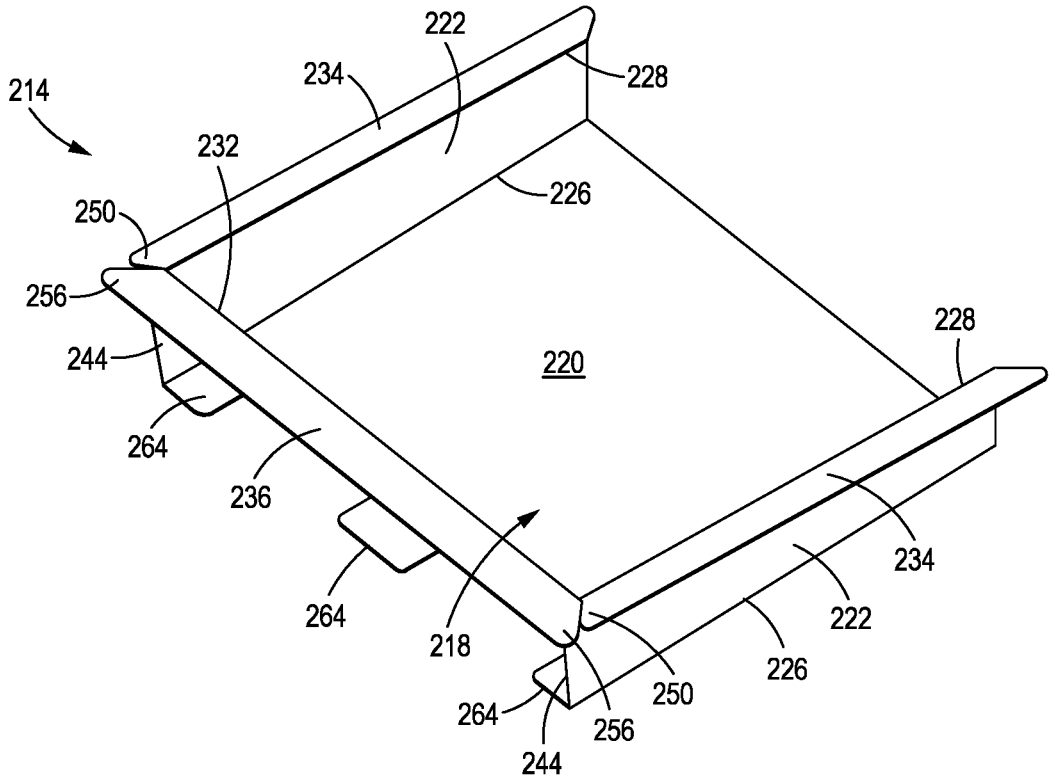
FIG. 10 is a second side perspective view of the tray formed from the tray blank of FIG. 8 with the top tray end wall removed.
Figure 10A:
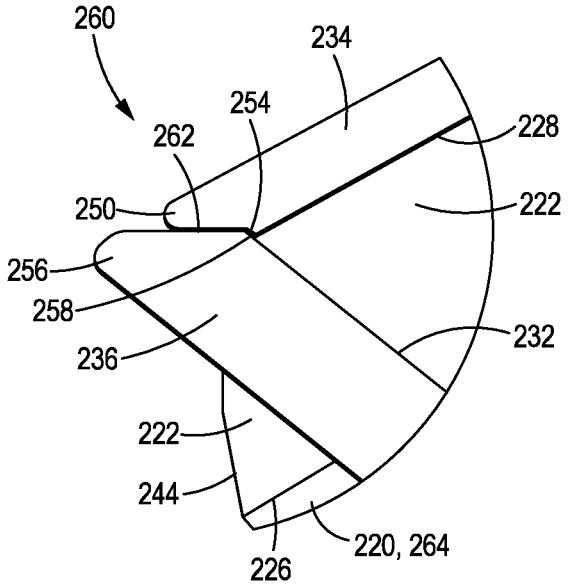
FIG. 10A is an enlarged view of detail 10A of FIG. 10.

FIG. 10 is a top perspective view of the tray 214 showing two of the interlocking corners 260. One of the interlocking corners 260 is also shown in the detail of FIG. 10A. Preferably, a shoulder length of the side flange shoulder 254 is greater than a lip length of the lip 258 so that the adjacent locking ends 250, 256 do not overlap and a diagonal gap 262 forms between the tray side flange 234 and the tray end flange 236. The lip 258 engages the side wall free edge 244 at the junction 252 (FIGS. 8A and 10A) and cooperates (interlocks) to limit the movement of the tray side wall 222 and the tray end wall 224. More specifically, the lip 258 and the junction 252 cooperate to prevent the tray side wall 222 and the end wall 24 from moving too far inward toward the tray cavity 218.

Figure 11:
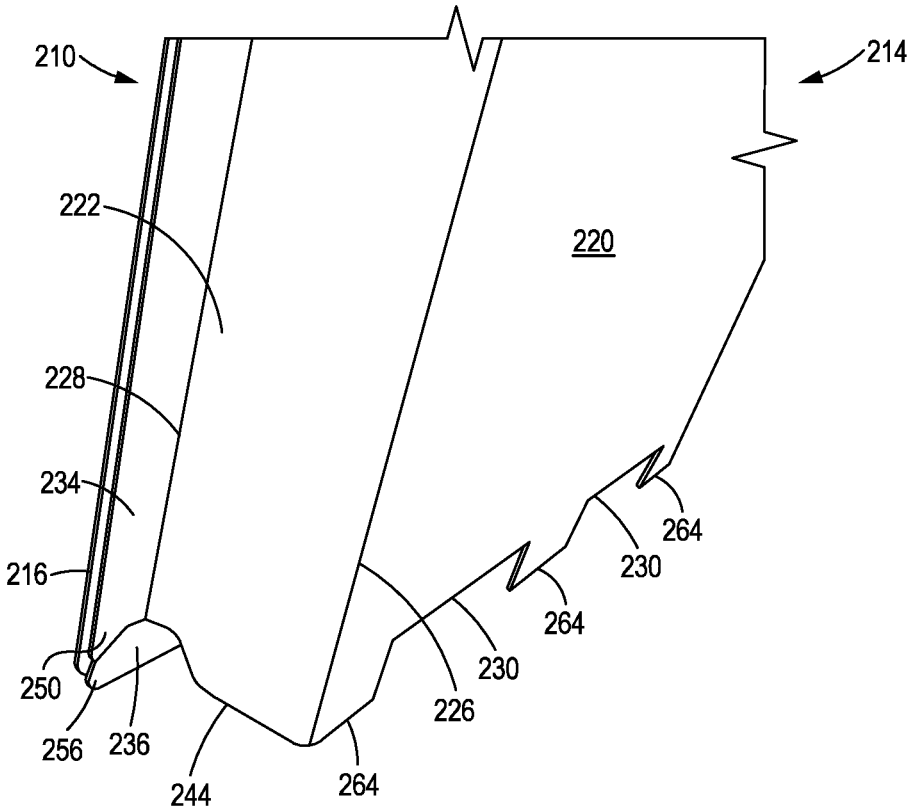
FIG. 11 is a perspective view of a lower portion of a blister package formed with the tray of FIGS. 9 and 10 with the blister package in a standing position.

FIG. 11 is a partial perspective view of the package 210 in a standing position. The package 210 may rest on a bottom edge of the face card 216 and on integrally formed feet 264 of the tray bottom wall 220. As shown in FIG. 8, foot cuts 266 may be made in the tray blank 240 between the tray bottom wall 220 and the bottom tray end wall 224 and alternated with the end wall fold lines 230. When the bottom tray end wall 224 is folded about the end wall fold line 230, the feet 264 and corresponding portions of the tray side walls 222 extend past the bottom tray end wall 224 as shown in FIGS. 9, 10 and 10A. If the package 210 has the foot feature, such as the feet 264 in the illustrated embodiment, the flange length of the bottom tray end flange 236 can affect the resting angle of the standing package. The bottom tray end flange 236 and/or the bottom edge of the face card 216 extends as far as the feet 264 to orient the package 210 vertically, or past the feet 264 as shown in FIG. 11 to lean the package 210 back at a predetermined resting angle. Also, artwork may be printed on the sealing side of the face card 216 as well as UPC codes that could be blocked by a tray side flange 234 or a tray end flange 236 that is outside of its proper location. Interlocking ensures flanges 234, 236 are properly positioned for the desired resting angle.

Figure 12:
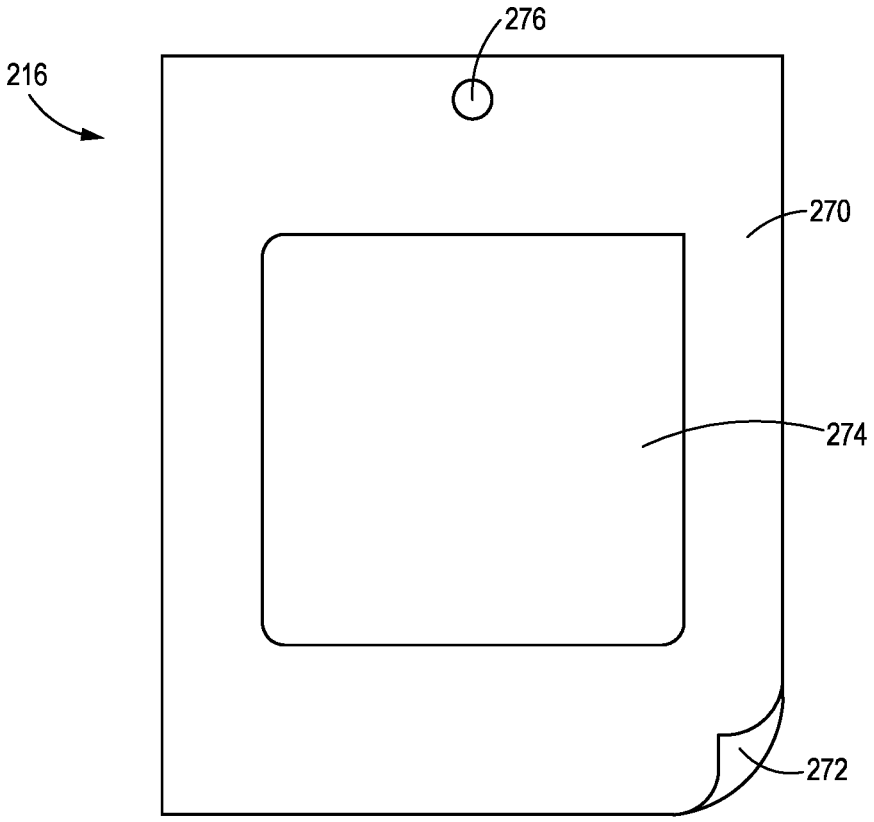
FIG. 12 is a top plan view of a face card of the blister package of FIG. 11.

In some cases, a window opening may be provided for the consumer to see the product 12 in the tray cavity 218 of the package 210. FIG. 12 is a top plan view of the face card 216 used to make the package 210. The face card 216 has a card front side 270 and a card back side 272 and may have graphics printed on one or both card sides 270, 272. The face card 216 may define an optional card opening 274 to enable the consumer to see all or part of the product 12. The window 274 may or may not be covered with a transparent film. If not covered, the window 274 allows a consumer to touch the product 12. The window 274 should be of a shape that prevents the products 12 from being removed through the window 274. For example, the window 274 may be shorter and/or narrower than the products 12 so that the products 12 do not protrude through the window 274. Other holes or openings may be incorporated into the face card 216 either as decorative features or for more utilitarian purposes. For example, the face card 216 may define a small card hole 276 located near the top of the package 10 for accommodating a rod or hook for retail display purposes.

In the blister package 10, the flanges 34, 36 can be designed to be located very close to the card opening 274. When the tray side walls 22 or the tray end walls 24 are moved out of position due to the absence of the interlocking feature in accordance with the present disclosure, the flanges 34, 36 may be positioned to be exposed through the card opening 274 and partially obscure the product 12 and cause a less than desirable appearance. In the blister package 210 with the interlocking feature described herein, the tray side walls 222 and one or both of the tray end walls 224 engage to ensure the correct positioning of the tray walls 222, 224 so that the flanges 234, 236 do not extend into the card opening 274 and do not obscure the view of the product 12 contained in the package 210.

A heat seal coating may be applied to the face card 216 on the card back side 272 (i.e., tray facing) prior to the face card 216 being sealed to a tray 214. The heat seal coating can be spot-applied or flooded across the entire face of the face card 216. The type and method of coating may be based upon customer need and product shape and geometry.

INDUSTRIAL APPLICABILITY

Thus, there has been described a mono-material package 210 that may be paper-based and thus fully recyclable. The packaging components can be shipped flat and loaded easily into existing blister package equipment such as the blister forming apparatus 50. The package 210 may be formed in the apparatus 50 just prior to the filling operation, and a paper-to-paper seal may be achieved in the same fashion as a traditional plastic blister back card seal.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A blister package for holding one or more products, the blister package comprising:

a face card; and a tray made from a tray blank fabricated from a recyclable material, the tray comprising:

a tray bottom wall having a perimeter defined by two side wall fold lines and two end wall fold lines, two opposing tray side walls attached to the tray bottom wall along the side wall fold lines and extending upward from the tray bottom wall to side flange fold lines, each tray side wall having two side wall free edges, two opposing tray end walls attached to the tray bottom wall along the end wall fold lines and extending upward from the tray bottom wall to end flange fold lines, each tray end wall having two end wall free edges, two opposing tray side flanges, each tray side flange extending outward from and attached to a corresponding one of the tray side walls along a corresponding one of the side flange fold lines, each tray side flange having at least one side flange locking end extending laterally beyond the corresponding side flange fold line, wherein the side flange locking end of the tray side flange, the side wall free edge of the tray side wall and the side flange fold line meet at a junction, and wherein the tray side flange and the side wall free edge of the side wall are contoured to define a side flange shoulder in the tray side flange adjacent the junction, and two opposing tray end flanges, each tray end flange extending outward from and attached to a corresponding one of the tray end walls along a corresponding end flange fold line, at least one tray end flange extending laterally beyond the corresponding end flange fold line to form a lip that projects outward beyond the end wall free edge of the tray end wall at approximately a 90° angle, wherein the lip engages the tray side wall at the junction to maintain alignment of the tray side flange, the tray end flange, the tray side wall and the tray end wall.

2. The blister package according to claim 1, wherein a shoulder length of the side flange shoulder is greater than a lip length of the lip.

3. The blister package according to claim 2, wherein each tray end flange has at least one end flange locking end that extends laterally beyond the end flange fold line, and wherein the side flange locking end and the end flange locking end do not overlap when the lip engages the tray side wall at the junction.

4. The blister package according to claim 1, wherein the end wall free edge is parallel to the corresponding side wall fold line.

5. The blister package according to claim 1, wherein the end wall free edge is angled outward relative to the corresponding side wall fold line as the end wall free edge extends away from the tray bottom wall.

6. The blister package according to claim 1, wherein a foot cut is made in the tray blank between the tray bottom wall and one of the tray end walls so that a foot of the tray bottom wall extends past the tray end wall and the end wall fold line when the tray end wall is folded about the end wall fold line.

7. A tray blank for forming a tray of a blister package for a product, the tray blank being fabricated from a recyclable material, the tray blank comprising:

a tray bottom wall;

a first tray side wall connected to the tray bottom wall along a first side wall fold line and having a first side wall free edge at each end of the first tray side wall;

a first tray side flange connected to the first tray side wall along a first side flange fold line opposite the first side wall fold line;

a second tray side wall connected to the tray bottom wall along a second side wall fold line opposite the first side wall fold line and having a second side wall free edge at each end of the second tray side wall;

a second tray side flange connected to the second tray side wall along a second side flange fold line opposite the second side wall fold line;

a first tray end wall connected to the tray bottom wall along a first end wall fold line extending from the first side wall fold line to the second side wall fold line and having a first end wall free edge at each end of the first tray end wall;

a first tray end flange connected to the first tray end wall along a first end flange fold line opposite the first end wall fold line;

a second tray end wall connected to the tray bottom wall along a second end wall fold line extending from the first side wall fold line to the second side wall fold line opposite the first end wall fold line and having a second end wall free edge at each end of the second tray end wall, wherein the first side wall fold line, the second side wall fold line, the first end wall fold line and the second end wall fold line define a perimeter of the tray bottom wall;

a second tray end flange connected to the second tray end wall along a second first end flange fold line opposite the second end wall fold line, wherein the second tray end flange extends laterally beyond ends of the second end flange fold line to define lips that engage the corresponding first side wall free edge and second side wall free edge when the tray blank is folded into the tray to limit the rotation of the second tray end wall about the second end wall fold line at a predetermined position.

8. The tray blank according to claim 7, wherein the first tray side flange is contoured to define a first side flange shoulder at the first side wall free edge proximate the second tray end wall, wherein the first side flange shoulder extends outward from a first junction of the first side flange fold line and the first side wall free edge approximately perpendicular to the first side flange fold line, and wherein the second tray side flange is contoured to define a second side flange shoulder at the second side wall free edge proximate the second tray end wall, wherein the second side flange shoulder extends outward from a second junction of the second side flange fold line and the second side wall free edge approximately perpendicular to the second side flange fold line.

9. The tray blank according to claim 8, wherein a shoulder length of the first side flange shoulder and the second side flange shoulder is greater than a lip length of the lips.

10. The tray blank according to claim 9, wherein the engagement of the lips with the first side wall free edge and the second side wall free edge prevents the second tray end flange from overlapping with the first tray side flange and the second tray side flange when the tray bank is folded into the tray.

11. The tray blank according to claim 7, wherein the second end wall free edges are parallel to the first side wall fold line and the second side wall fold line.

12. The tray blank according to claim 7, wherein the second end wall free edges are angled outward relative to the corresponding one of the first side wall fold line and the second side wall fold line as the second end wall free edges extend away from the tray bottom wall.

13. The tray blank according to claim 7, wherein a foot cut is made in the tray blank between the tray bottom wall and the second tray end wall so that a foot of the tray bottom wall extends past the second tray end wall and the second end wall fold line when the second tray end wall is folded about the second end wall fold line.

14. A tray for a blister package for a product, the tray formed from a tray blank fabricated from a recyclable material, the tray comprising:

a tray bottom wall;

a first tray side wall connected to the tray bottom wall and folded along a first side wall fold line to extend upward from the tray bottom wall, and having a first side wall free edge at each end of the first tray side wall;

a first tray side flange connected to the first tray side wall and folded along a first side flange fold line opposite the first side wall fold line to extend horizontally outward from the first tray side wall;

a second tray side wall connected to the tray bottom wall and folded along a second side wall fold line opposite the first side wall fold line to extend upward from the tray bottom wall, and having a second side wall free edge at each end of the second tray side wall;

a second tray side flange connected to the second tray side wall and folded along a second side flange fold line opposite the second side wall fold line to extend horizontally outward from the second tray side wall;

a first tray end wall connected to the tray bottom wall and folded along a first end wall fold line extending from the first side wall fold line to the second side wall fold line to extend upward from the tray bottom wall, and having a first end wall free edge at each end of the first tray end wall;

a first tray end flange connected to the first tray end wall and folded along a first end flange fold line opposite the first end wall fold line to extend horizontally outward from the first tray end wall;

a second tray end wall connected to the tray bottom wall and folded along a second end wall fold line extending from the first side wall fold line to the second side wall fold line opposite the first end wall fold line to extend upward from the tray bottom wall, and having a second end wall free edge at each end of the second tray end wall, wherein the first side wall fold line, the second side wall fold line, the first end wall fold line and the second end wall fold line define a perimeter of the tray bottom wall;

a second tray end flange connected to the second tray end wall and folded along a second first end flange fold line opposite the second end wall fold line to extend horizontally outward from the second tray end wall, wherein the second tray end flange extends laterally beyond ends of the second end flange fold line to define lips engaging the corresponding first side wall free edge and second side wall free edge and limiting the rotation of the second tray end wall about the second end wall fold line at a predetermined position.

15. The tray according to claim 14, wherein the first tray side flange is contoured to define a first side flange shoulder at the first side wall free edge proximate the second tray end wall, wherein the first side flange shoulder extends outward from a first junction of the first side flange fold line and the first side wall free edge approximately perpendicular to the first side flange fold line, and wherein the second tray side flange is contoured to define a second side flange shoulder at the second side wall free edge proximate the second tray end wall, wherein the second side flange shoulder extends outward from a second junction of the second side flange fold line and the second side wall free edge approximately perpendicular to the second side flange fold line.

16. The tray according to claim 15, wherein a shoulder length of the first side flange shoulder and the second side flange shoulder is greater than a lip length of the lips.

17. The tray according to claim 16, wherein the engagement of the lips with the first side wall free edge and the second side wall free edge prevents the second tray end flange from overlapping with the first tray side flange and the second tray side flange.

18. The tray according to claim 14, wherein the second end wall free edges are parallel to the first side wall fold line and the second side wall fold line.

19. The tray according to claim 14, wherein the second end wall free edges are angled outward relative to the corresponding one of the first side wall fold line and the second side wall fold line as the second end wall free edges extend away from the tray bottom wall.

20. The tray according to claim 14, wherein a foot cut is made in the tray blank between the tray bottom wall and the second tray end wall so that a foot of the tray bottom wall extends past the second tray end wall and the second end wall fold line.

* * * * *